United States Patent [19]

Harrison

[11] Patent Number: 4,565,589

[45] **Date of Patent: * Jan. 21, 1986**

[54] NICKEL/TITANIUM/COPPER SHAPE MEMORY ALLOY

[75] Inventor: John D. Harrison, Watsonville, Calif.

[73] Assignee: Raychem Corporation, Menlo Park, Calif.

[ * ] Notice: The portion of the term of this patent subsequent to Jun. 29, 1999 has been disclaimed.

[21] Appl. No.: 537,316

[22] Filed: Sep. 28, 1983

Related U.S. Application Data

[63] Continuation-in-part of Ser. No. 355,274, Mar. 5, 1982, abandoned.

[51] Int. Cl.[4] ..... C22C 19/03

[52] U.S. Cl. ..... 148/402; 420/457

[58] Field of Search ..... 148/402; 420/457

[56] References Cited

U.S. PATENT DOCUMENTS

| | | |
|---|---|---|
| 3,174,851 | 3/1965 | Buehler et al. . |
| 3,351,463 | 11/1967 | Rozner et al. . |
| 3,558,369 | 1/1971 | Wang et al. . |
| 3,740,839 | 6/1973 | Otte et al. . |
| 3,753,700 | 8/1973 | Harrison et al. . |
| 3,832,243 | 8/1974 | Donkersloot et al. . |
| 4,035,077 | 7/1977 | Harrison et al. . |
| 4,144,057 | 3/1979 | Melton et al. . |
| 4,198,081 | 4/1980 | Harrison et al. . |
| 4,205,293 | 5/1980 | Melton et al. . |
| 4,293,942 | 10/1981 | Baumgartner . |
| 4,337,090 | 6/1982 | Harrison . |

FOREIGN PATENT DOCUMENTS

| | | |
|---|---|---|
| 2111372 | 9/1972 | Fed. Rep. of Germany . |
| 606456 | 12/1977 | Switzerland . |
| 1591213 | 6/1981 | United Kingdom . |

OTHER PUBLICATIONS

"Nitinols are Nonmagnetic, Corrosion Resistant, Hardenable" Buehler et al., Mater. Des. Eng., pp. 82–83, (Feb. 1962).

"Crystal Structure and a Unique 'Martensitic' Transition of TiNi", Wang et al., J. App. Phys., V. 36, pp. 3232–3239, (1965).

"Homogeniety Range and the Martensitic Transformation in TiNi" Wasilewski et al., Met. Trans., V. 2, pp. 229–238, (1971).

"Effects of Alloying Upon Certain Properties of 55.1 Nitinol" Golstein et al., NOLTR 64–235, (1965).

"Effects of Additives V, Cr, Mn, Zr on the Transformation Temperature of TiNi Compound", Homma et al., Res. Inst. Mi. Dress. Met. Report 622, (1972).

"The Structure of NiTiCu Shape Memory Alloys" Bricknell et al., Met. Trans. A, V. 10A, pp. 693–697, (1979).

"Effect of Alloying on the Critical Points and Hysteresis . . . ", Chernov et al., Dokl. Akad. Nauk SSSR, V. 245, pp. 360–362, (1979), (Trans.).

"The Substitution of Cr for Ni in TiNi Shape Memory Alloys", Mercier et al., Met. Trans. A, V 10A, pp. 387–389, (1979).

"Deformation Behaviour of NiTi-Based Alloys", Melton et al., Met. Trans. A, V. 9A, pp. 1487–1488, (1978).

"The Effect of Opposing Stress on Shape Memory and Martensitic Reversion", Melton et al., Scripta Met., V. 12, pp. 5–9, (1978).

"Zum Aufbau des Systems Ti-Ni-Cu . . . ", Pfeifer et al., J. Less-Common Metal, V. 14, pp. 291–302, (1968).

"Mechanical Properties of TiNi-TiCu Alloys", Erkhim et al., Metal Science & Heat Treatment, V. 20, pp. 652–653, (1978).

"Nitinol Characterization Study", Cross et al., NASA CR-1433, (1969), esp. pp. 51–53.

*Primary Examiner*—R. Dean

*Attorney, Agent, or Firm*—Ira D. Blecker; James W. Peterson

[57] ABSTRACT

Nickel/titanium alloys containing less than a stoichiometric quantity of titanium, which have a high austenitic yield strength and are capable of developing the property of shape memory at a temperature above 0° C., may be stabilized by the addition of from 7.5 to 14 atomic percent copper. These stabilized alloys also possess improved workability and machinability.

4 Claims, 2 Drawing Figures

NICKEL/TITANIUM/COPPER SHAPE MEMORY ALLOY

CROSS-REFERENCE TO RELATED APPLICATION

This application is a continuation-in-part of my copending application, Ser. No. 355,274, filed Mar. 5, 1982, abandoned the entire disclosure of which is incorporated herein by reference.

BACKGROUND OF THE INVENTION

1. Field of the Invention

This invention relates to nickel/titanium shape memory alloys and improvements therein.

2. Discussion of the Prior Art

Materials, both organic and metallic, capable of possessing shape memory are well known. An article made of such materials can be deformed from an original, heat-stable configuration to a second, heat-unstable configuration. The article is said to have shape memory for the reason that, upon the application of heat alone, it can be caused to revert, or to attempt to revert, from its heat-unstable configuration to its original, heat-stable configuration, i.e. it "remembers" its original shape.

Among metallic alloys, the ability to possess shape memory is a result of the fact that the alloy undergoes a reversible transformation from an austenitic state to a martensitic state with a change in temperature. This transformation is sometimes referred to as a thermoelastic martensitic transformation. An article made from such an alloy, for example a hollow sleeve, is easily deformed from its original configuration to a new configuration when cooled below the temperature at which the alloy is transformed from the austenitic state to the martensitic state. The temperature at which this transformation begins is usually referred to as the $M_s$ temperature. When an article thus deformed is warmed to the temperature at which the alloy starts to revert back to austenite, referred to as the $A_s$ temperature, the deformed object will begin to return to its original configuration.

Shape memory alloys have found use in recent years in, for example, pipe couplings such as are described in U.S. Pat. Nos. 4,035,077 and 4,198,081 to Harrison and Jervis, and electrical connectors such as those described in U.S. Pat. No. 3,740,839 Otte and Fischer, the disclosures of which are incorporated by reference herein.

These alloys also find use in switches, such as are disclosed in U.S. Pat. No. 4,205,293, and actuators, etc. For such application, it is generally desirable that the $A_s$ temperature should be above ambient, so that the alloy element will remain in its martensitic state unless heated either externally or by the passage of an electric current through it. Because of the hysteresis of the austenite-martensite transformation, the desired $M_{50}$, the temperature at which the transformation to martensite is 50% complete, will will generally be above 0° C. for an $A_s$ above, say, 20° C.

Especially in the case of switches, actuators, and heat engines, in which the shape memory alloy element may be subject to repeated cycling between the austenitic and martensitic states under load, shape memory "fatigue" may be a problem. Cross et al, NASA Report CR-1433 (1969), pp. 51–53, discuss briefly this phenomenon, which they term "shape recovery fatigue", and indicate that there may be a significant loss in recovery at higher strain levels for binary nickel-titanium.

For shape memory applications in general, a high austenitic yield strength is desirable, as this minimizes the amount of the somewhat expensive alloy required and the size of the article.

Various alloys of nickel and titanium have in the past been disclosed as being capable of having the property of shape memory imparted thereto. Examples of such alloys may be found in U.S. Pat. No. 3,174,851 and 3,351,463.

Buehler et al (Mater. Des. Eng., pp. 82–3 (February 1962); J. App. Phys., v. 36, pp. 3232–9 (1965)) have shown that in the binary Ni/Ti alloys the transformation temperature decreases dramatically and the yield strength increases with a decrease in titanium content from the stoichiometric (50 atomic percent) value. However, lowering the titanium content below 49.9 atomic percent has been found to produce alloys which are unstable in the temperature range of 100° C. to 500° C., as described by Wasilewski et al., Met. Trans., v. 2, pp. 229–38 (1971). The instability (temper instability) manifests itself as a change (generally an increase) in $M_s$ between the annealed alloy and the same alloy which has been further tempered. Annealing here means heating to a sufficiently high temperature and holding at that temperature long enough to give a uniform, stress-free condition, followed by sufficiently rapid cooling to maintain that condition. Temperatures around 900° C. for about 10 minutes are generally sufficient for annealing, and air cooling is generally sufficiently rapid, though quenching in water is necessary for some of the low Ti compositions. Tempering here means holding at an intermediate temperature for a suitably long period (such as a few hours at 200°–400° C.). The instability thus makes the low titanium alloys disadvantageous for shape memory applications, where a combination of high yield strength and reproducible $M_s$ is desired.

Certain ternary Ni/Ti alloys have been found to overcome some of these problems. An alloy comprising 47.2 atomic percent nickel, 49.6 atomic percent titanium, and 3.2 atomic percent iron (such as disclosed in U.S. Pat. No. 3,753,700 to Harrison, et al.) has an $M_s$ temperature near −100° C. and a yield strength of about 70,000 psi. While the addition of iron has enabled the production of alloys with both low $M_s$ temperature and high yield strength, this addition has not solved the problem of instability, nor has it produced a great improvement in the sensitivity of the $M_s$ temperature to compositional change.

U.S. Pat. No. 3,558,369 shows that the $M_s$ temperature can be lowered by substituting cobalt for nickel, then iron for cobalt in the stoichiometric alloy. However, although the alloys of this patent can have low transformation temperatures, they have only modest yield strengths (40,000 psi or less).

U.S. Naval Ordnance Laboratory Report NOLTR 64-235 (August 1965) examined the effect upon hardness of ternary additions of from 0.08 to 16 weight percent of eleven different elements to stoichiometric Ni/Ti. Similar studies have been made by, for example, Honma et al., Res. Inst. Min. Dress. Met. Report No. 622 (1972), on the variation of transformation temperature with ternary additions.

U.S. Pat. No. 4,144,057 shows that the addition of copper to NiTi alloys containing traces of at least one other metal produces alloys in which the transformation temperature is relatively less dependent on the composition than it is in the binary alloys. Such a control of transformation temperature is referred to in U.S. Pat No. 4,144,057 as "stabilization". This use of "stabilization" should be distinguished from the use made by the present applicant, who, as stated before, uses "stability" to refer to freedom from change of transformation temperature with conditions of manufacture.

Two further requirements for these shape memory alloys should be noted. These are workability and machinability. Workability is the ability of an alloy to be plastically deformed without crumbling or cracking, and is essential for the manufacture of articles (including even test samples) from the alloy. Machinability refers to the ability of the alloy to be shaped, such as by turning or drilling, economically. Although machinability is not solely a property of the alloy, Ni/Ti alloys are known to be difficult to machine (see, e.g., Machining Data Handbook, 2nd Ed. (1972) for comparative machining conditions for various alloys), i.e. they are expensive to shape, and a free-machining nickel/titanium shape memory alloy would be extremely economically attractive.

While U.S. Pat. No. 4,144,057 shows that control of transformation temperature with composition may be achieved by the addition of copper, it does not suggest compositions or conditions which produce alloys having good stability (as defined above), workability, and machinability: all of which properties are important for the economic manufacture of memory metal articles.

In particular, U.S. Pat. No. 4,144,057 is directed principally towards alloys containing sufficient titanium that ternary addition is not required for temper stability. Further, it fails to distinguish between those elements which are believed to assist in providing temper stability, e.g. Al and Zr, and those which do not, e.g. Co and Fe.

As stated in my U.S. Pat. No. 4,377,090, I have discovered that the addition of copper to nickel/titanium alloys having a low transition temperature (an $A_{50}$, the temperature at which the transformation to austenite is 50% complete, in the range of from −50° C. to −196° C.) provides a significant improvement in temper stability, enabling the production of high yield strength, low $M_s$ alloys.

DESCRIPTION OF THE INVENTION

Summary of the Invention

I have also discovered that the addition of appropriate amounts of copper to nickel/titanium shape memory alloys having an $M_s$ above 0° C. can significantly improve the machinability and temper stability of the alloy and enable the manufacture of a shape memory alloy with both high yield strength and high $M_s$.

In one aspect, this invention provides memory alloys consisting essentially of nickel, titanium, and copper which display high strength, an $M_{50}$(20 ksi) temperature above 0° C., stability, and good workability and machinability. The alloys consist essentially of from 36 to 44.75 atomic percent nickel, from 44.5 to 50 atomic percent titanium, and the remainder copper.

DETAILED DESCRIPTION OF THE PREFERRED EMBODIMENTS

Shape memory alloys according to the invention may conveniently be produced by the methods described in, for example, U.S. Pat. Nos. 3,737,700 and 4,144,057. The following example illustrates the method of preparation and testing of samples of shape memory alloys.

EXAMPLE

Commercially pure titanium, carbonyl nickel, and OFHC copper were weighed in proportions to give the initial atomic percentage compositions listed in Table I (the total mass for test ingots was about 330 g). These metals were placed in a water-cooled copper hearth in the chamber of an electron beam melting furnace. The chamber was evacuated to $10^{-5}$ Torr and the charges were melted and alloyed by use of the electron beam. The resulting ingots were hot swaged and hot rolled in air at approximately 850° C. to produce strip of approximately 0.025 in. thickness. After de-scaling, samples were cut from the strip and vacuum annealed at 900° C.

The annealed samples were cooled and re-heated while the change in resistance was measured. From the resistance-temperature plot, the temperature at which the martensitic transformation was complete, the $M_f$ temperature, was determined. The transformation temperature of each alloy was determined as the temperature at which 50% of the total deformation had occurred under 20 ksi load, referred to as the $M_{50}$ (20 ksi) temperature.

After tempering each sample for two hours at 400° C., the tests were repeated. The average of the temperature shift of the resistivity change and of $M_{50}$ (20 ksi) was used as an index of instability: the greater the absolute value of the index, the greater the instability. The yield strength of annealed samples was measured at temperatures high enough to avoid the formation of stress-induced martensite, i.e. at 80° C. above $M_s$. Values for $M_{50}$ (20 ksi), the yield strength, the instability index, and the workability are listed in Table I. On the basis of these data, the preferred initial composition limits for this invention have been defined.

TABLE I

Properties of Nickel/Titanium/Copper Alloys

| Initial Composition, Atomic Percent | | | $M_{50}$ (20 ksi) | Yield Strength | Instability | |
|---|---|---|---|---|---|---|
| Ni | Ti | Cu | °C. | ksi | Index | Workability |
| 43.0 | 49.0 | 8.0 | −5 | 80 | −2 | |
| 42.0 | 50.0 | 8.0 | 64 | 33 | −4 | |
| 44.0 | 46.0 | 10.0 | −45 | 110 | 4 | |
| 43.0 | 47.0 | 10.0 | 11 | 79 | 2 | |
| 42.0 | 48.0 | 10.0 | 27 | 98 | −1 | |
| 41.0 | 49.0 | 10.0 | 11 | 87 | −1 | |
| 40.5 | 49.5 | 10.0 | — | — | — | No |
| 40.0 | 50.0 | 10.0 | — | — | — | No |
| 43.0 | 45.0 | 12.0 | −23 | — | 1 | |
| 42.0 | 46.0 | 12.0 | 11 | 103 | 0 | |
| 41.0 | 47.0 | 12.0 | 15 | 98 | 0 | |
| 40.0 | 46.0 | 14.0 | 5 | 105 | 1 | |
| 39.0 | 45.0 | 16.0 | — | — | — | No |
| 38.0 | 46.0 | 16.0 | — | — | — | No |
| 37.0 | 47.0 | 16.0 | −32 | 94 | 0 | |
| 36.0 | 48.0 | 16.0 | — | — | — | No |
| 34.0 | 50.0 | 16.0 | — | — | — | No |

Figure 1:
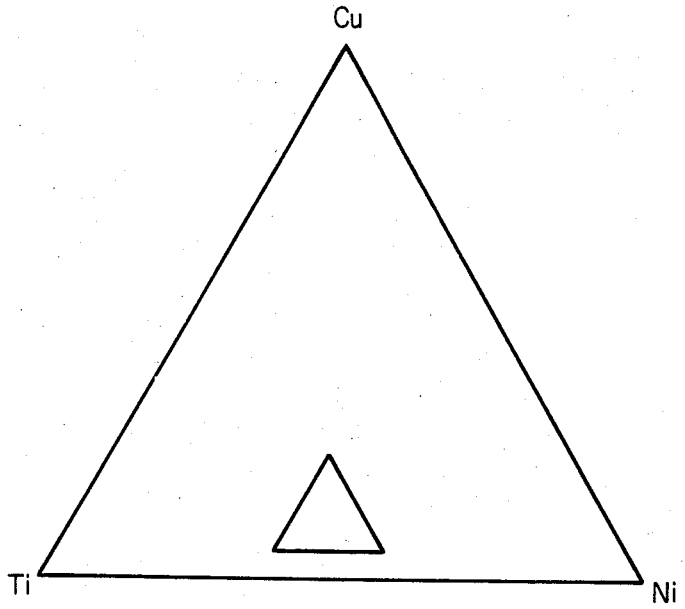
FIG. 1 is the nickel/titanium/copper ternary composition diagram showing the general area of the alloy of this invention.

The initial composition of the alloy of this invention can be described by reference to an area on the nickel, titanium, and copper ternary composition diagram. The general area of the alloy on the composition diagram is shown by the small triangle in FIG. 1. This area of the composition diagram is enlarged and shown in FIG. 2. The initial compositions at the points A,B,C, and D are shown in Table II below.

TABLE II

| Point | Initial Atomic Percent Composition Nickel | Titanium | Copper |
|---|---|---|---|
| A | 42.00 | 49.50 | 8.50 |
| B | 35.50 | 49.50 | 15.00 |
| C | 41.00 | 44.00 | 15.00 |
| D | 44.25 | 47.25 | 8.50 |

The lines AB and BC correspond approximately to the workability limit of these alloys, while the lines CD and DA correspond approximately to an $M_{50}$ (20 ksi) of 0° C.

Figure 2:
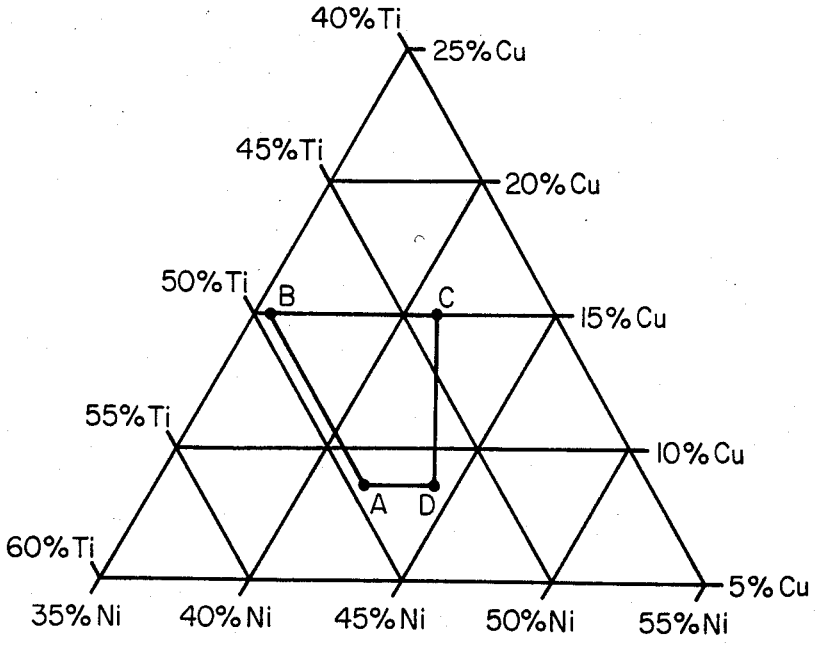
FIG. 2 is an enlargement of a portion of the composition diagram, showing the claimed initial composition region.

As the extent of thermally recoverable plastic deformation (shape memory) that can be induced in these alloys decreases with decreasing titanium content, the particularly preferred alloys of this invention will lie nearer line AB (the high titanium line) of the quadrilateral ABCD of FIG. 2.

I have found that the final compositions of these alloys differ from the initial compositions when the alloys are prepared by electron-beam melting (the technique I have usually employed). Analysis by, inter alia, conventional gravimetric methods and quantitative X-ray fluorescence indicates that the final compositions of alloys such as are described in Table I are approximately 1 atomic percent lower in copper than the initial compositions of the melting charges.

The reason for this discrepancy is believed to be that in the low pressure, high temperature environment of the electron-beam furnace there is an evaporation of the melting charge of typically about 10–1.3%. Because copper has a significantly higher vapor pressure at the formation temperature of the alloy than the two major components, nickel and titanium, it is believed that the majority of the metal lost by evaporation is copper. This supposition is largely confirmed by the observation that, if alloy compositions are calculated from the initial composition and the weight loss assuming the entire weight loss to be copper, the resulting calculated compositions are in good agreement with with the actual analytical results. (Honma et al., Res. Inst. Min. Dress. Met. Report No. 622 (1972), have reported loss of chromium and manganese when attempting to prepare ternary nickel/titanium alloys by electron-beam melting.)

Of course, while a certain change in composition appears to be inherent in the electron-beam alloying technique, other alloying techniques, such as arc melting under an inert atmosphere, may not produce the same compositional changes. In fact, I would expect that a lesser degree of copper loss would result if the alloying were to be done at atmospheric pressure.

Accordingly, although the preferred compositional range was characterized as an initial charge for an electron-beam alloying process, since the desired properties of the alloys are determined by the final compositions, however achieved, final compositions are given in Table III.

TABLE III

| Point | Final Atomic Percent Composition. Nickel | Titanium | Copper |
|---|---|---|---|
| A' | 42.50 | 50.00 | 7.50 |
| B' | 36.00 | 50.00 | 14.00 |
| C' | 41.50 | 44.50 | 14.00 |
| D' | 44.75 | 47.75 | 7.50 |

The alloys of this invention also exhibit a greater resistance to shape memory fatigue than binary alloys. For example, a copper alloy showed less than half the loss of recoverability of an equivalently processed binary after 1000 cycles of fatigue testing at about 40 ksi load.

It has been found that the alloys of this invention possess machinability which is unexpectedly considerably better than would be predicted from similar Ni/Ti alloys. While not wishing to be held to any particular theory, it is considered that this free-machining property of the alloys is related to the presence of a second phase, possibly $Ti_2(Ni,Cu)_3$, in the TiNi matrix. It is therefore considered that this improved machinability will manifest itself only when the titanium content is below the stoichiometric value and the Ti:Ni:Cu ratio is such as to favor the formation of the second phase.

In addition to the method described in the Example, alloys according to the invention may be manufactured from their components (or appropriate master alloys) by other methods suitable for dealing with high-titanium alloys. The details of these methods, and the precautions necessary to exclude oxygen and nitrogen either by melting in an inert atmosphere or in vacuum, are well known to those skilled in the art and are not repeated here.

Alloys obtained by these methods and using the materials described will contain small quantities of other elements, including oxygen and nitrogen in total amounts from about 0.05 to 0.2 percent. The effect of these materials is generally to reduce the martensitic transformation temperature of the alloys.

The alloys of this invention possess good temper stability, are hot-workable, and are free-machining in contrast to prior art alloys. They are also capable of possessing shape memory, and have a $M_{50}$(20 ksi) temperature above 0° C.

I claim:

1. A shape memory alloy consisting essentially of nickel, titanium, and copper within an area defined on a nickel, titanium, and copper ternary composition diagram by a quadrilateral with its first vertex at 42.5 atomic percent nickel, 50.0 atomic percent titanium, and 7.5 atomic percent copper; its second vertex at 36.0 atomic percent nickel, 50.0 atomic percent titanium, and 14.0 atomic percent copper; its third vertex at 41.5 atomic percent nickel, 44.5 atomic percent titanium, and 14.0 atomic percent copper, and its fourth vertex at 44.75 atomic percent nickel, 47.75 atomic percent titanium, and 7.5 atomic percent copper.

2. A shape memory alloy according to claim 1 which consists essentially of from 41.0 to 42.0 atomic percent nickel, from 49.0 to 50.0 atomic percent titanium, and from 8.5 to 9.5 atomic percent copper.

3. A shape memory alloy consisting essentially of nickel, titanium, and copper, said alloy being prepared by the electron-beam melting of a charge consisting essentially of nickel, titanium, and copper within an area defined on a nickel, titanium, and copper ternary composition diagram by a quadrilateral with its first vertex at 42 atomic percent nickel, 49.5 atomic percent titanium, and 8.5 atomic percent copper; its second vertex at 35.5 atomic percent nickel, 49.5 atomic percent titanium, and 15 atomic percent copper; its third vertex at 41 atomic percent nickel, 44 atomic percent titanium, and 15 atomic percent copper, and its fourth vertex at 44.25 atomic percent nickel, 47.25 atomic percent titanium, and 8.5 atomic percent copper.

4. A shape memory alloy according to claim 3 in which the charge consists essentially of from 40.5 to 41.5 atomic percent nickel, from 48.5 to 49.5 atomic percent titanium, and from 9.5 to 10.5 atomic percent copper.

* * * * *